US006685327B2

(12) United States Patent
Dörrie

(10) Patent No.: US 6,685,327 B2
(45) Date of Patent: Feb. 3, 2004

(54) ARRANGEMENT FOR ILLUMINATING THE ADJUSTING KNOB OF AN INPUT UNIT BY MEANS OF TRANSMITTED LIGHT

(75) Inventor: Christian Dörrie, Karlsruhe (DE)

(73) Assignee: Siemens AG, Munich (DE)

( * ) Notice: Subject to any disclaimer, the term of this patent is extended or adjusted under 35 U.S.C. 154(b) by 37 days.

(21) Appl. No.: 09/877,831

(22) Filed: Jun. 8, 2001

(65) Prior Publication Data

US 2002/0075668 A1 Jun. 20, 2002

(30) Foreign Application Priority Data

Jun. 9, 2000 (DE) ..... 200 10 428 U

(51) Int. Cl.[7] ..... F21V 8/00; F21N 101/00
(52) U.S. Cl. ..... 362/27; 362/23; 362/26
(58) Field of Search ..... 362/27, 30, 85, 362/555; 374/131; 116/202, 284; 200/316; 340/57, 84; 350/96.24

(56) References Cited

U.S. PATENT DOCUMENTS 2,602,036 A * 7/1952 Sullivan ..... 116/DIG. 31
4,734,918 A * 3/1988 Bauer et al. ..... 116/202
5,047,761 A * 9/1991 Sell ..... 116/288
5,335,148 A * 8/1994 Tominaga ..... 362/26
6,176,589 B1 * 1/2001 Ishiguro ..... 362/23

* cited by examiner

*Primary Examiner*—Sandra O'Shea
*Assistant Examiner*—James W Cranson, Jr.
(74) *Attorney, Agent, or Firm*—Jacob Eisenberg; Siemens Schweiz AG

(57) ABSTRACT

For a rotary switch (7) fastened on a dividing wall (1), it is proposed to illuminate the adjusting knob (4) by means of transmitted light by providing as a light guide (20) a conical ring (28) formed with continuations (29, 30, 31) formed on in the axial direction, the continuations (29, 30, 31) reaching through the dividing wall (1) and being aligned with light-emitting diodes (8, 9), which are located on a printed-circuit board (6) assigned to the rotary switch (7). The light guide (20) is fastened on the dividing wall (1) indirectly by fastening the housing (3) and is secured against twisting by suitable indentations (47, 48, 49) in the dividing wall (1).

8 Claims, 2 Drawing Sheets

4
14
15
13
20/27
1
44
29
2
3
5
11
12

14
4
13
3
15
1

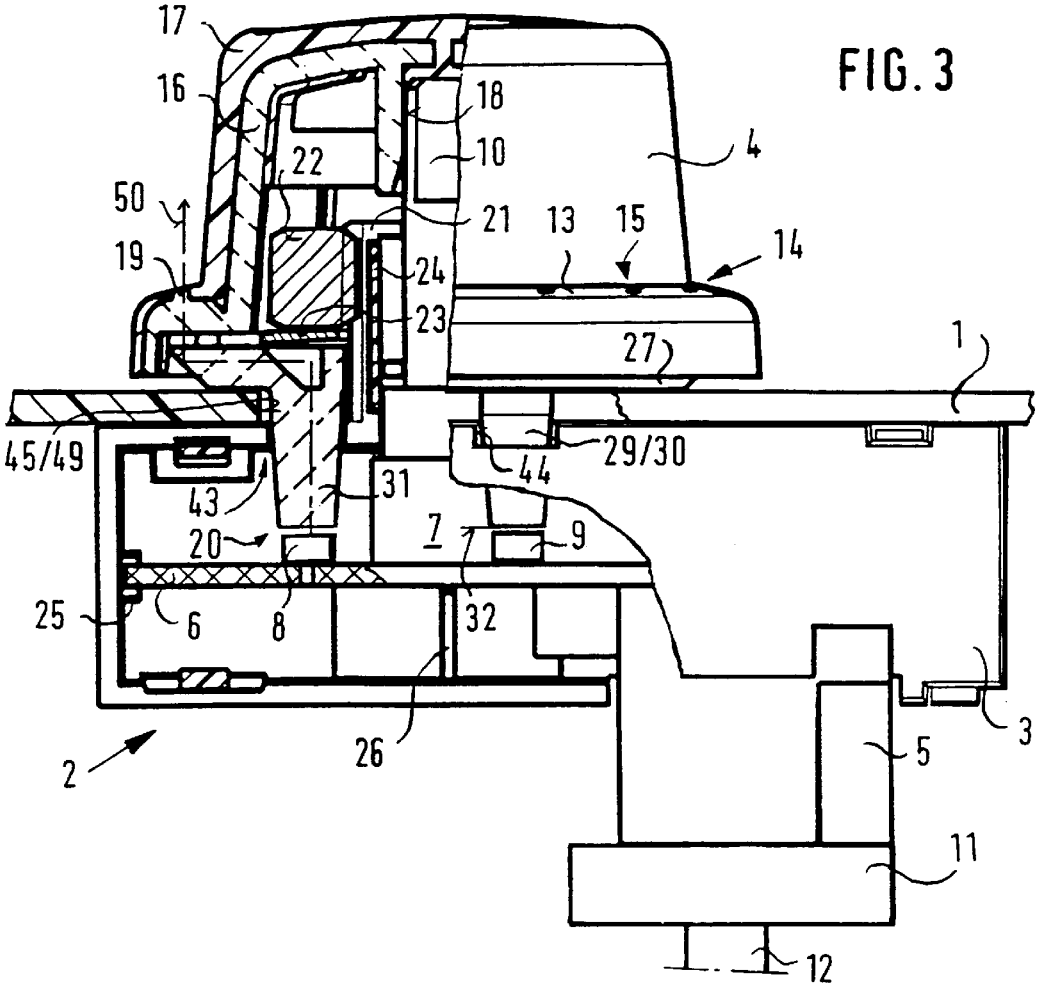
FIG. 3
FIG. 4
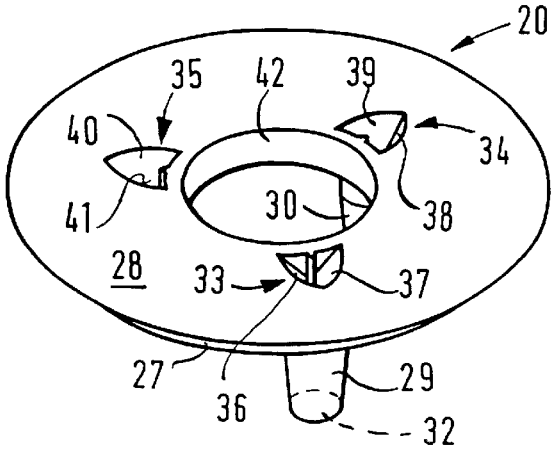
FIG. 5
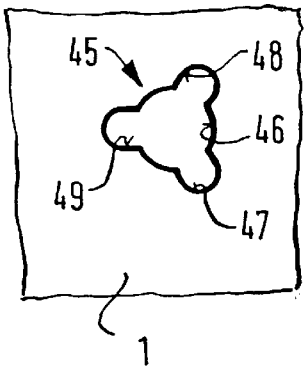

ARRANGEMENT FOR ILLUMINATING THE ADJUSTING KNOB OF AN INPUT UNIT BY MEANS OF TRANSMITTED LIGHT

BACKGROUND OF THE INVENTION

1. Field of Invention

The invention relates to an arrangement for illuminating the adjusting knob of an input unit by means of transmitted light, the input unit having a rotary switch which is fastened on a dividing wall and the setting stem of which, carrying the adjusting knob, reaches through to the opposite side of the dividing wall, and at least one light source being provided, located on the rotary switch side.

2. Description of the Prior Art

The transmitted-light illumination of the adjusting knobs of input units which are to be flange-mounted on a dividing wall, for example on a dashboard, is problematical to the extent that, by contrast with a commercially available, ready-to-install device, the input unit, adjusting knob and light-guiding means have to be assembled directly at the dividing wall. At the same time, because of the dominance of illumination of this type at night-time, the uniform illumination of the adjusting knob has to meet high requirements, whether the latter is intended to light up in its entirety or only in an outer region, or markings or scales of the adjusting knob are to be made distinguishable. On the other hand, in particular in a case where the setting unit [sic] is used in a motor vehicle, the conditions of mass production and mass assembly must be taken into account for the illumination of the adjusting knob.

It was consequently an object of the present invention to illuminate by means of transmitted light the adjusting knob of an input unit assigned in the generic way to a dividing wall, with as little outlay as possible.

SUMMARY OF THE INVENTION

The way in which this object is achieved is characterized in that a light guide is provided, in that on the light guide there is formed a light-exiting face corresponding to the region of the adjusting knob to be illuminated, in that the light guide is fastened on the dividing wall on the adjusting knob side and in that the light guide reaches through the dividing wall to the light source. A preferred embodiment provides that the rotary switch is assigned a printed-circuit board, that contacted light-emitting diodes serve as the light source on the printed-circuit board and that the light guide is designed as a conical ring with light-guiding continuations formed on in the axial direction and assigned to the light-emitting diodes.

It can be seen as the decisive advantage offered by the invention that only a single light-guiding component, produced by the injection-molding process, is required for the light guidance between the light source and the adjusting knob and that homogeneous illumination of the adjusting knob, in the case of the exemplary embodiment of a row of illuminated points provided peripherally around the adjusting knob and visually representing, for example, the switching steps of the rotary switch, can be realized with just three light-emitting diodes. It must also be emphasized that the light guide according to the invention can be fastened in a simple way, that is to say indirectly when the input unit is fastened. In the case of the particularly advantageous coaxial arrangement, according to the exemplary embodiment, the light guide represents as it were a shim, the flange surfaces not being optically relevant. In this connection, it should be emphasized that the light guidance provided within the light guide has only a few optically effective faces, that is to say necessitates faces of a high surface quality. Furthermore, the light guide in interaction with the through-opening which is located in the dividing wall and is provided with indentations, or in interaction with bores which are assigned to the through-opening and are provided for the reaching through of the light-guide channels or the light-guiding continuations of the light guide, represents a twist-preventing means for the input unit if the rotary switch is assigned a housing and the fastening of the input unit takes place by means of a threaded lug formed on the housing. On account of the twist-preventing function, the fastening moment can be reduced and, in this way, fastening that does not cause any damage and is resistant to creep can be achieved for the plastic housing receiving the input unit.

It is of fundamental significance that this makes it possible in a simple way for the invention to guide a light serving for the transmitted-light illumination of an adjusting knob, or else the illumination of a scale formed on an adjusting knob, from one side of a dividing wall, for example a dashboard, on which the input unit concerned is flange-mounted, to the other side of the dividing wall, on which the adjusting knob is located.

For the sake of completeness, it should also be pointed out that the scale of a rotary switch with a limited rotating angle can also be illuminated in the same way by means of transmitted light, it possibly being necessary for such sectoral illumination that only two light-emitting diodes are provided or only one light-emitting diode is provided as the light source. Moreover, a wide variety of rings of light or designs of scales, for example also rows of symbols, can be illuminated in the way according to the invention by means of transmitted light. The same applies to various configurations of adjusting knobs. Furthermore, as represented in the exemplary embodiment, an arrangement of a light guide and adjusting knob may also be set up in such a way that the adjusting knob reaches around the light guide and in this way cuts out scattered light, or the adjusting knob is arranged at a certain distance from the light guide and consequently a halo of light is produced on the dividing wall as a result of the emerging scattered light.

The light distribution which can be achieved with the arrangement according to the invention, that is to say with a minimum of light-emitting diodes, and the uniform illumination of the adjusting knob or of the ring of illuminated points provided for illuminating the adjusting knob is [sic] caused to a great extent by the deflecting faces which are formed at the depressions of the light guide and are assigned to the light-guiding continuations. In this arrangement, each deflecting face guides the received light into a portion of the ring that is asymmetrical with respect to the annular form of the light guide, whereby an overlapping of the streams of light of two neighboring deflecting faces occurs. This additionally achieves the advantage of compensating for differences in brightness between the light-emitting diodes used. The sector-shaped regions of low light intensity, existing in theory symmetrically in relation to the radial planes of intersection of the deflecting faces or parting planes of the depressions, are, as tests show, sufficiently flooded with light on account of the arrangement and formation of the deflecting faces.

BRIEF DESCRIPTION OF THE DRAWINGS

The invention will be explained in more detail below with reference to drawings, in which:

FIG. 3 shows a representation enlarged in comparison with FIG. 1 of the input unit with several part-sections, FIG. 4 shows a perspective representation of the light guide, FIG. 5 shows a plan view of the dividing wall in the region of a through-opening assigned to the input unit.

DETAILED DESCRIPTION OF THE PREFERRED EMBODIMENT

Figure 1:
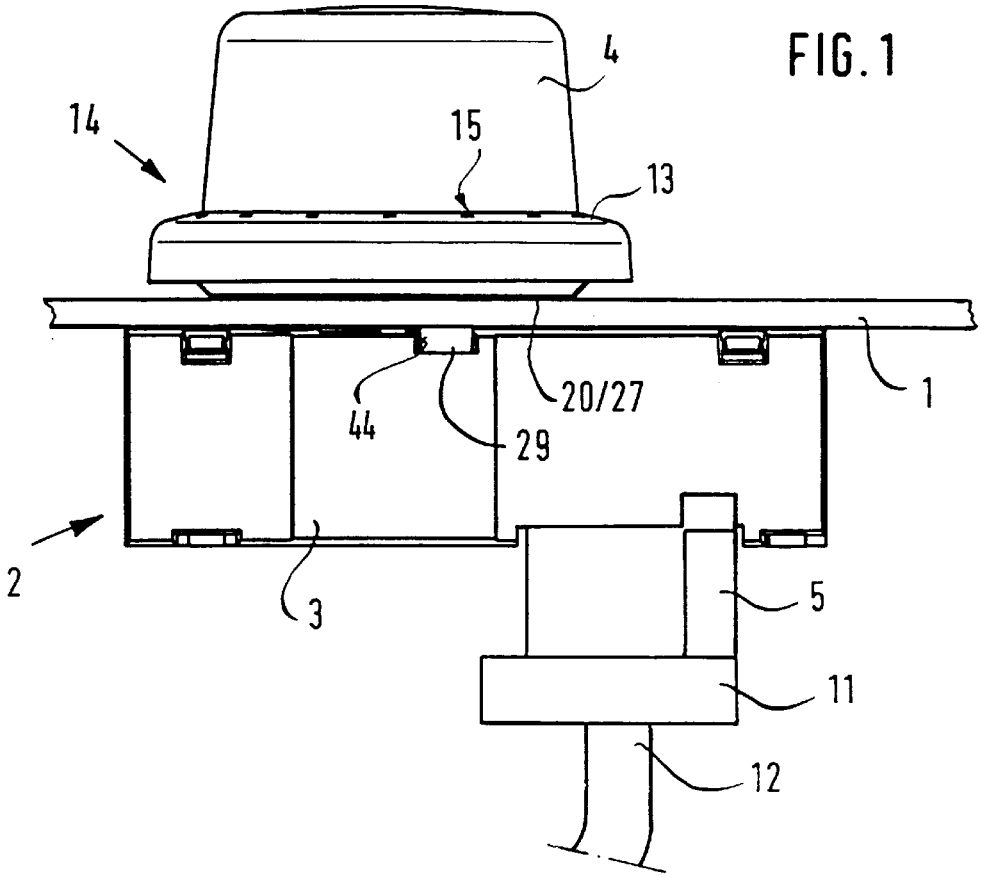
FIG. 1 shows a side view of an input unit mounted on a dividing wall.
Figure 2:
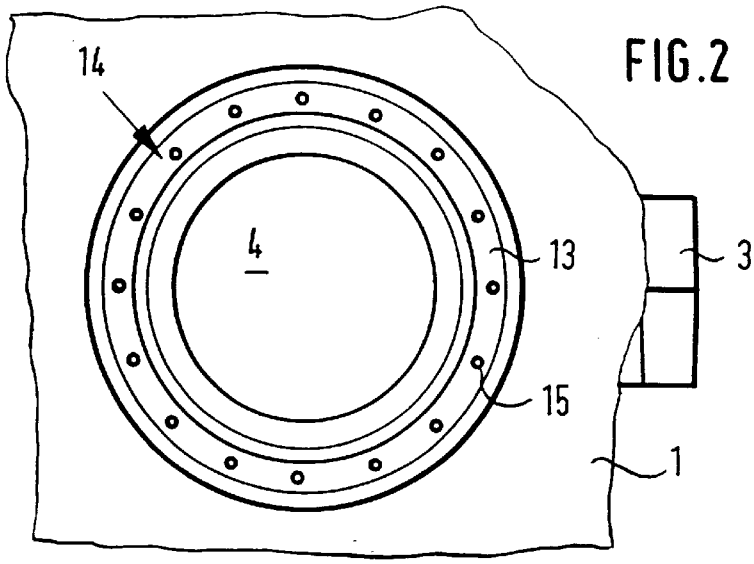
FIG. 2 shows a plan view of the input unit according to FIG. 1.

FIG. 1, serving as a general representation, shows an input unit 2 fastened on a dividing wall 1, with a housing 3 being arranged on one side and an adjusting knob 4 being arranged on the opposite side of the dividing wall 1. 5 denotes a plug socket, which, as FIG. 3 reveals, is connected to a printed-circuit board 6 secured in the housing 3. Said printed-circuit board carries a rotary switch or a rotationally and axially actuable switch 7, means for supplying power and processing signals and also light-emitting diodes, two of which are represented in FIG. 3 and are denoted by 8 and 9. A partially D-shaped setting stem, which is assigned to the rotary switch 7 and on which the adjusting knob 4 is fastened, is denoted by 10. 11 represents a plug, which terminates the cable 12 and is accommodated in the plug socket 5. As can be seen from the drawings, the adjusting knob 4 is of a stepped shape, with a graduation 14, corresponding for example to the switching steps of the rotary switch 7, being formed on the annular face 13 of the step. The graduation elements, one of which is denoted by 15, are designed in the case of the chosen exemplary embodiment to be capable of being illuminated in a punctiform manner and by means of transmitted light. In an appropriate way, the adjusting knob 4 is produced by the two-component injection-molding process, that is to say the adjusting knob 4 comprises a relatively hard, light-conducting support 16, produced from PMMA, and a relatively soft, easy-to-grip and opaque shell 17, produced from TPE. Formed on the support 16 are a mount 18 for the connection of the adjusting knob 4 to the setting stem 10 and also pins 19 which correspond to the number of graduation elements and the end faces of which represent the graduation elements 15. In a corresponding way, the shell 17, which is positively interlocked with the support 16, is designed in such a way that the end faces of the pins 19 are exposed.

20 denotes a light guide, which is fixed on the dividing wall 1 indirectly by fastening the housing 3, which reaches through the dividing wall 1 with a threaded lug 21.

The fastening of the housing 3 takes place by means of a nut 22, which is assigned a spring washer 23. In this connection, it should also be mentioned that the housing 3 is made up of two housing components, the parting plane axially intersecting the threaded lug 21 and the halves of the threaded lug having fillets and depressions assigned to the latter formed on them as joining elements. One of the fillets is represented in FIG. 3 and denoted by 24. Furthermore, it should also be pointed out that the two housing components are joined together by means of bayonet-type and latching connecting means, which are not specifically denoted because they are not essential for the invention. As can also be seen from FIG. 3, securing means 25 and rib elements 26 formed on the housing components serve for receiving and supporting the printed-circuit board 6.

The light guide 20, which like the support 16 of the adjusting knob 4 is produced from PMMA, essentially comprises a flat ring 28, which is provided with a conical outer face 27 and on which continuations 29, 30 and 31 serving as light-guide channels are formed. The end faces or light-entering faces of the continuations 29, 30, 31, one of which is denoted in FIG. 4 by 32, may also be convexly designed for concentrating the light, are polished to avoid light losses. The deflecting outer surface 27, effective as a light-exiting face, and deflecting faces 36, 37, 38, 39, 40 and 41, formed in depressions 33, 34 and 35, are also provided with the same surface quality, the depressions 33, 34 and 35 being formed on the opposite side of the light guide 20 in extension of the continuations 29, 30, 31. In this arrangement, the suitably curved deflecting faces of the individual depressions 33, 34 and 35 are not formed concentrically in relation to the outer surface 27 but in such a way that they intersect in a radial plane respectively of the light guide 20. An annular light-exiting face of the light guide 20, facing the adjusting knob 4, is formed in a roughened manner in order to achieve uniform illumination of the graduation 14 by light scattering. 42 denotes the central opening in the light guide 20, corresponding to the threaded lug 21 of the housing 3. The reference numerals 43 and 44 denote two of the bores required for the continuations 29, 30, 31 to pass through into the housing 3.

It is illustrated by FIG. 5 that a through-opening 45 serving for the fastening of the input unit on the dividing wall 1 has on the one hand a receptacle 46 assigned to the threaded lug 21, on the other hand indentations 47, 48 and 49 provided for the passing through of the continuations 29, 30, 31 of the light guide 20. An arrow denoted by 50 symbolizes the light guidance between a light-emitting diode 8 and a graduation element 15 of the adjusting knob 4.

What is claimed is:

1. An arrangement of illuminating an adjusting knob of an input unit by means of transmitted light, the input unit having a rotary switch which is fastened on a dividing wall and a setting stem of which, carrying the adjusting knob, reaches through to an opposite side of the dividing wall, and at least one light source being provided, located on the rotary switch side, characterized in that a light guide is provided, in that on the light guide there is formed a light-exiting face corresponding to the region of the adjusting knob to be illuminated, in that the light guide is secured against rotation and fixed on the dividing wall on the adjusting knob side, the light guide reaches through the dividing wall to the light source, a light-guide channel with a light entering face assigned to the light source is formed on the light guide, the light guide being fastened on the dividing wall indirectly when the input unit is fastened, the fastening of the input unit takes place by means of a screwed connection, with a threaded lug being provided on the input unit, and in that a receptacle corresponding to the diameter of the threaded lug and a clearance serving for the leading through of the light-guide channel are formed in the dividing wall.

2. Arrangement according to claim 1, characterized in that the rotary switch (7) is assigned a printed-circuit board (6) and in that a light-emitting diode (8, 9) with contacts established on the printed-circuit board (6) serves as the light source.

3. Arrangement according to claim 1, characterized in that the light guide (20) is designed as a conical ring (28) with at least one continuation (29, 30, 31), which is formed on in the axial direction and serves as a light-guide channel.

4. Arrangement according to claim 3, characterized in that continuations (29, 30, 31) are formed on the light guide (20) at angular intervals of 120° and in that each continuation (29, 30, 31) is assigned a light-emitting diode (8, 9) arranged on the printed-circuit board (6).

5. Arrangement according to claim 4, characterized in that partially conically formed depressions (33, 34, 35) are provided in extension of the continuations (29, 30, 31) on the side of the light guide (20) facing away from the continuations (29, 30, 31).

6. Arrangement according to claim 5, characterized in that the depressions (29, 30, 31) have in each case two conical deflecting faces (36, 37, 38, 39, 40, 41), the deflecting faces (36, 37, 38, 39, 40, 41) being formed non-concentrically in relation to the light-exiting outer surface (27) of the light guide (20).

7. Arrangement according to claim 4, characterized in that the input unit (2), essentially comprising rotary switch (7), printed-circuit board (6) and light-emitting diodes (8, 9), is assigned a housing (3) and in that additional bores (43, 44) for the entry of the continuations (29, 30, 31) are formed in the housing wall, which is provided with an opening for the exit of the setting stem (10).

8. Arrangement according to claim 1, characterized in that the adjusting knob (4) has at the edge a ring of transparently formed graduation elements (15) and in that an annular light-exiting face, formed in a light-scattering manner and assigned to the outer surface 27, is provided on the light guide (20).

* * * * *